US009731545B2

(12) United States Patent
Flippo

(10) Patent No.: US 9,731,545 B2
(45) Date of Patent: Aug. 15, 2017

(54) PIVOTING CONSTRUCTION SQUARE AND MULTIPURPOSE MEASURING TOOL

(71) Applicant: Curt Flippo, Sarasota, FL (US)

(72) Inventor: Curt Flippo, Sarasota, FL (US)

( * ) Notice: Subject to any disclaimer, the term of this patent is extended or adjusted under 35 U.S.C. 154(b) by 35 days.

(21) Appl. No.: 14/312,935

(22) Filed: Jun. 24, 2014

(65) Prior Publication Data

US 2014/0373372 A1 Dec. 25, 2014

Related U.S. Application Data

(60) Provisional application No. 61/838,695, filed on Jun. 24, 2013.

(51) Int. Cl.
*B43L 7/10* (2006.01)

(52) U.S. Cl.
CPC ..... *B43L 7/10* (2013.01)

(58) Field of Classification Search
CPC ..... B43L 7/10; B43L 7/12; G01B 3/56
USPC ..... 33/418–423
See application file for complete search history.

(56) References Cited

U.S. PATENT DOCUMENTS 1,189,983 A * 7/1916 McLeod ..... G01B 3/56 33/421
1,210,370 A * 12/1916 Dvorak ..... G01B 3/56 33/341
1,916,638 A * 7/1933 Rizianu ..... B43L 7/12 33/418
1,999,105 A * 4/1935 Milla ..... G01B 3/56 33/453
2,656,609 A * 10/1953 Siggson ..... G01C 9/26 33/41.1
3,289,301 A * 12/1966 Hanson ..... B25H 7/04 33/353
4,598,482 A * 7/1986 Castleton ..... B25H 7/02 33/482
4,729,173 A * 3/1988 Wilson ..... G01B 3/566 33/451
4,955,141 A * 9/1990 Welch ..... G01B 3/56 33/418
5,384,967 A * 1/1995 Helmuth ..... B43L 7/10 33/416
5,446,969 A * 9/1995 Terenzoni ..... B25H 7/00 33/419

(Continued)

*Primary Examiner* — Yaritza Guadalupe-McCall
(74) *Attorney, Agent, or Firm* — Global Intellectual Property Agency, LLC; Daniel Boudwin

(57) ABSTRACT

A pivoting construction square is provided for measuring angles between adjacent planes, for drafting arcs or circles, and for quickly comparing measured angles to a roof pitch. The device comprises a first and second arm member pivotably attached to one another, wherein the outer ends thereof include apertures for accepting a writing utensil therein. A cross member is connected therebetween, one end thereof being pivotably fixed and the other being slidably disposed within an elongated rail. A locking pin member is adapted to lock the slidable end. Measurement indicia are provided along one arm to correspond to angles, while a quick reference guide comparing angles to roof pitch is also provided. Both arms include a bubble level, while one arm further includes a plurality of aligned apertures to receive a writing utensil. In this way, the device functions as a construction square, a compass, a ruler, and a protractor.

10 Claims, 4 Drawing Sheets

(56) References Cited

U.S. PATENT DOCUMENTS

| | | | | |
|---|---|---|---|---|
| 5,669,149 | A * | 9/1997 | Meitzler | G01B 3/56 33/417 |
| 6,105,267 | A | 8/2000 | Hathaway | |
| 6,122,834 | A * | 9/2000 | Rester | B25H 7/02 33/449 |
| 6,199,288 | B1 * | 3/2001 | Gregory | B25H 7/02 33/32.2 |
| 6,314,652 | B1 * | 11/2001 | English | G01B 5/24 33/419 |
| 7,406,774 | B2 * | 8/2008 | Shapiro | G01B 3/563 33/471 |
| 7,958,645 | B1 * | 6/2011 | Chappell | G01B 3/566 33/474 |
| 8,122,609 | B2 * | 2/2012 | Farr | B43L 7/12 33/417 |
| 8,375,592 | B1 * | 2/2013 | Holt | B43L 7/12 33/456 |
| 2003/0217473 | A1 | 11/2003 | Pampel | |
| 2011/0107610 | A1 * | 5/2011 | Farr | B43L 7/12 33/421 |
| 2013/0025142 | A1 * | 1/2013 | Holt | B43L 7/12 33/456 |
| 2014/0373372 | A1 * | 12/2014 | Flippo | B43L 7/10 33/418 |

* cited by examiner

PIVOTING CONSTRUCTION SQUARE AND MULTIPURPOSE MEASURING TOOL

CROSS REFERENCE TO RELATED APPLICATION

This application claims the benefit of U.S. Provisional Application No. 61/838,695 filed on Jun. 24, 2013. The above identified patent application is herein incorporated by reference in its entirety to provide continuity of disclosure.

BACKGROUND OF THE INVENTION

Field of the Invention

The present invention relates to construction square tools and devices for measuring angles. More specifically, the present invention relates to a pivoting construction square tool with the ability to be used in several capacities and provide a quick reference guide for the user when measuring a roof pitch in a construction environment.

Construction squares are devices that facilitate measuring right angles and ensuring two joining surfaces are plumb. Similar to construction squares are pivoting construction squares, which combine the measuring features of standard construction squares and add the capacity to measure a plurality of angles intermediate to and beyond ninety degrees. The former includes a pair of arms in a static arrangement, while the latter comprises a pair of arms in pivoting relationship, wherein a single pivot point disposed along overlapping ends of each arm provide a scissor tool to measure angles between adjacent surfaces. Various applications exist for these tools, mostly in the construction and home building fields.

Measuring angles with a pivoting construction square involves aligning the pivoting arms to a desired angle or pressing the same against two surfaces, and thereafter registering the angle marker indicia provided. This allows construction workers to rapidly assess the angle between to members to determine compliance with plans. This operation is well known in the art of pivoting construction squares. However, for those construction workers building pitched roofs, the angle of the roof relative to another member or the horizontal is not traditionally measured in angles, but rather in slope as described by the rise distance over a given run (generally 12 inches). This requires one measuring roof to do intermediate calculations when measuring a roof pitch using a standard pivoting construction square tool, which provides angular measurements and not slope ratios.

The present invention facilitates rapid measurement of roof pitch angles and eliminates intermediate calculations by the user. The present invention comprises a pivoting construction square that includes indicia thereon representing a quick reference guide between angular measurements and roof pitch ratios. Furthermore, the present invention provides a multipurpose tool that allows the user to deploy a single tool when measuring or marking various items, including measuring pitch, lengths and angles, as well as marking arc lengths and semi-circles in a similar fashion as a compass tool. Overall, the device advances the art of pivoting construction squares by facilitate comparison of measured angles to roof pitch ratios, and moreover by expanding the capacity of the tool to measure or mark various items without switching tools.

Description of the Prior Art

Devices have been disclosed in the prior art that relate to pivoting construction squares and related tools. These include devices that have been patented and published in patent application publications. These devices generally relate to various constructions for pivoting construction squares and those that include some additional features. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 1,916,638 to Rizianu, which discloses a folding square with a pair of pivotably attached blades and an adjusting brace member therebetween. The connection therebetween includes a sliding rail and a turn screw using a countersunk fastener configuration. While providing a device for measuring angles, the Rizianu device fails to provide a bubble level, quick reference indicia for comparing angles to roof pitches, and further does not include the capacity to be used as a drawing compass.

Folding squares that incorporate a bubble level include U.S. Patent Publication No. 2003/0217473 to Pampel and U.S. Pat. No. 4,955,141 to Welch. These devices incorporate a one-way or two-axis bubble level within one or more of the arms of the disclosed folding square. However, these devices fail to contemplate a set of indicia along one or more of the arms for roofers and construction users when erecting and measuring the pitch of a roof, wherein reference between the measured angle and the desired roof pitch is necessary. Furthermore, these devices fail to contemplate the capacity to draw arcs and circles, wherein the present invention can also function as a drafting compass. Several locations are present for placing a writing implement into the tool, wherein the opposite arm includes a location to secure the center point of the desired arc or circle. Further measurement indicia are provided along outer edge of one arm such that the radius of the arc is known when using the tool in such a manner, whereby the brace is locked at a desired radius such that the center point and the writing utensil distance is known.

Another device in the art is U.S. Pat. No. 8,375,592 to Holt, which discloses a construction square with a unique cross member and measurement indicia along one of the arms. The indicia include both linear indicia for length measurements and angle indicia adjacent to the pivot point of the cross member. While the Holt device provides angular and length measurement indicia, it fails to provide a means of comparing the angle to roof pitch using printed indicia, and further fails to provide a construction that would facilitate use of the device as a compass as contemplated herein.

Similar to the Holt device is U.S. Pat. No. 6,105,267 to Hathaway, which discloses a construction square having an indexing means such that the device can be locked into a specific angular configuration using a plurality of bores formed in the elongated slot of the construction square legs that are used to realize a specific angle when locking the device in a static state. Similar to Holt, however, the Hathaway device fails to contemplate the many different forms of measurement indicia provided by the present invention, nor does it provide a quick reference guide for roof pitch versus angle or a means of creating measured arcs using the construction square.

The present invention relates to a multipurpose tool that offers users the ability to measure linearly or angularly, to compare angular measurements to roof pitch, to determine pitch of a surface, and to create measured arc lengths or semi-circle marks similar to that of a protractor. The device includes a standard linear ruler, angular measurement indicia based on the separation of the tool arm members, and radius measurements along one edge when using the device as a protractor. Bubble levels along each arm allow for measuring the pitch of a surface when placed thereagainst.

Overall, the present invention advances the art of pivoting construction squares and offers a multi-purpose tool that improves efficiency. It is submitted as being substantially divergent in design elements from the prior art, and consequently it is clear that there is a need in the art for an improvement to existing pivoting construction square devices. In this regard the instant invention substantially fulfills these needs.

SUMMARY OF THE INVENTION

In view of the foregoing disadvantages inherent in the known types of hand tools and measurement devices now present in the prior art, the present invention provides a new pivoting construction square, wherein the same can be utilized for providing convenience for the user when taking linear or angular measurements, creating measured arc length marks, or for verifying a surface is either level or vertical.

It is therefore an object of the present invention to provide a new and improved pivoting construction square device that has all of the advantages of the prior art and none of the disadvantages.

It is another object of the present invention to provide a pivoting construction square device that provides two elongate arm members in pivoting and overlapping relationship, wherein a cross member is used to lock the relative angle between the arm members in a given state for measuring angles.

Another object of the present invention is to provide a pivoting construction square device that includes a quick reference guide thereon in the form of indicia, wherein a table of roof pitch ratio versus measured angle is provided.

Yet another object of the present invention is to provide a pivoting construction square device that can measure the orientation of a member and determine whether the member is vertical or horizontal using one of the two provided bubble levels.

Another object of the present invention is to provide a pivoting construction square device that includes linear ruler markings along one arm to measure linear distances.

Another object of the present invention is to provide a pivoting construction square device that includes angular markings along one arm to measure the angle between the two arm members.

Another object of the present invention is to provide a pivoting construction square device that includes a writing utensil aperture such that the device can be used as a protractor, wherein the radius of the arc length to be drawn is determinable via markings along the outer edge of an arm member.

Another object of the present invention is to provide a pivoting construction square device that includes a plurality writing utensil apertures such that consecutively smaller and parallel arcs can be drawn if desired.

Still yet another object of the present invention is to provide a pivoting construction square device that can complete a full 360 degree rotation without interference with any of the elements of the device, and wherein the device can be compacted into a linear configuration for storage.

Another object of the present invention is to provide a pivoting construction square device that includes a locking knob supported along an polymer spacer, wherein the locking knob can secure the device in a static state and the space includes a notch such that the angular separation of the arm members can be visualized.

A final object of the present invention is to provide a pivoting construction square device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
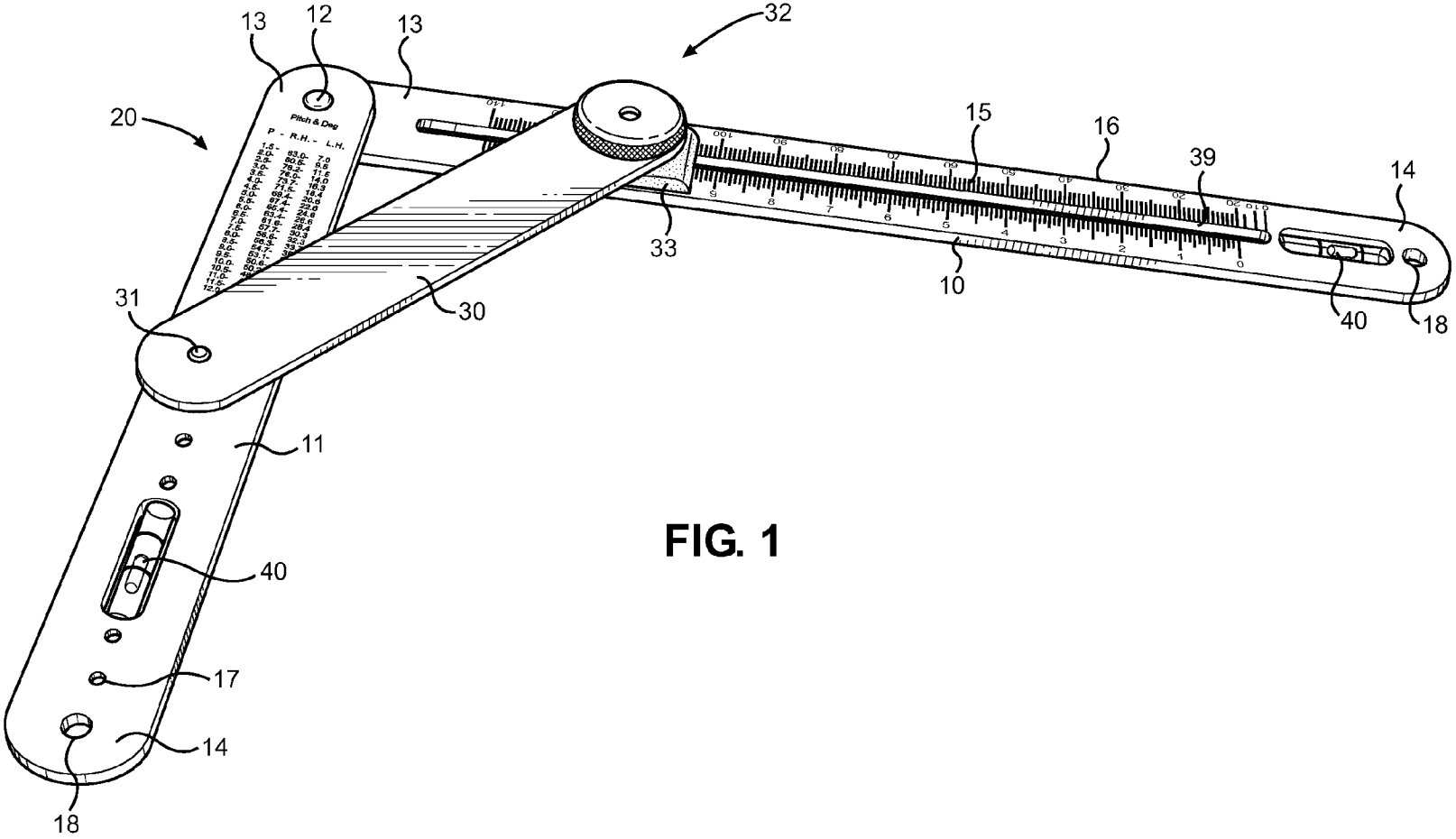
FIG. 1 shows a perspective view of the present invention in an expanded state.

Reference is made herein to the attached drawings. Like reference numerals are used throughout the drawings to depict like or similar elements of the pivoting construction square of the present invention. For the purposes of presenting a brief and clear description of the present invention, the preferred embodiment will be discussed as used for providing a multi-purpose tool for construction workers and individual users. The figures are intended for representative purposes only and should not be considered to be limiting in any respect.

Referring now to FIG. 1, there is shown a perspective view of the pivoting construction square of the present invention. The device comprises a measuring tool that includes a first arm member 10 and a second arm member 11 in pivoting relationship with one another to form a scissor configuration. Each arm member comprises a first end 13 and a second end 14, wherein the members are joined at their first ends 13 and provide a writing utensil aperture 18 along their second ends 14. The arms are joined by a first pivot joint 12, which comprises a stud or similar permanent fastener that allows the first 10 and second 11 arm member to freely pivot about the first joint 12 location.

Extending between the first 10 and second 11 arm members is a cross member 30, which is pivotably attached to the second arm member 11 by a cross member pivot joint 31 and slidably attached to the first arm member 10. The first end of the cross member is pinned to the second arm member 11 by way of the pivot joint, while second end thereof is slidably positionable along the length of the first arm member 10. The second end of the cross member 30 is secured to the first arm member 10 by a tightening knob 32 in connection with a fastener and a countersunk nut along the backside of the arm member 10. The fastener extends through a channel 39 in the first arm member 10, wherein the end of the cross member 30 can freely slide therein. Between the cross member 30 and the first arm member 10 is a polymer washer 33, which facilitates free sliding and furthermore provides a notch such that indicia along the first arm member 10 can be readily viewed when the cross member is disposed thereover.

The assembly can be locked into a static configuration by way of tightening the tightening knob 32, whereby the fastener thereof draws the cross member 30, polymer washer, and first arm member 10 together to increase the friction therebetween and prevent sliding of the cross member second end. This locks the assembly into a static state, whereby the angle between the two arm members is determinable by referencing measurement indicia placed on the first arm member 10. The fastener of the tightening knob is preferably threaded and engages a countersunk nut disposed within the first arm member 10 and below the channel 39. Tightening the knob 30 advances the fastener and draws the nut towards the knob 32 to secure the assembly at a desired angle.

Disposed within each arm member is a bubble level 40, which is a captive air bubble within a fluid capsule aligned with the arm members and having center indicia thereon to determine when the bubble is centered in the capsule. The bubble level 40 allows the user to place the outer edge of either arm member against a surface, whereby the user can determine if the surface is horizontal by using the arm member pressed thereagainst. Likewise the user can lock the assembly in a right angle (90 degree) state, whereafter the user can determine whether a surface is vertical by references the bubble level 40 disposed in the arm not pressed against the surface (i.e. the horizontal arm member). The user can utilize the assembly further to determine if disparate surfaces, either joined together or separated, are plumb to one another.

Several different types of indicia are placed on the pivoting construction square of the present invention in order to gauge different measurements and types of geometry. These include measurement indicia and a roof pitch quick reference indicia 20. The reference indicia 20 comprises a table that allows the user to take a measured angle from the device and convert it to roof pitch, which is generally represented in roof pitch ratios of rise over run. This eliminates the need for the user to perform any calculations when taking measurements during construction or inspecting completed work. The quick reference indicia 20 is preferably disposed between the pivot joints along the second arm member 11, however alternate positions along the device are contemplated.

The measurement indicia of the present invention include several different types for measuring different geometry. The first is a linear ruler measurement indicia 15 disposed along an edge of at least one of the arm members. The ruler measurements are markers that allow linear distance to be measured, wherein the scale may be provided in English units or metric units to suit the user. The next measurement indicia is disposed adjacent to the elongated channel 39 of the first arm member 10 and is used to show the angular separation of the arm members, wherein the interior angle is determined by the location of the cross member 30 and opposite thereof is readily calculated by subtracting the measured angle from 360 degrees. The polymer washer (preferably a nylon washer) includes a viewing notch 38 such that the exact angle at which the assembly is disposed can be readily viewed upon inspection (see FIG. 3).

The final measurement indicia are disposed along one minor edge (e.g. edge 16) of the first arm member 10, and are used to determine the distance between the two outermost writing utensil apertures 18 of the assembly. It is contemplated that the device can be used as a protractor when in a locked state, wherein writing utensils are positioned within the apertures 18 to create arc length marks. The radius of the arc length is determined by the distance between the apertures 18. This distance is calculated and marked along the edge of the first arm member 10, wherein the position of the tightening knob 32 shows the present radius (see FIG. 6). Intermediate utensil apertures 17 may also be provided along the second arm member 11 for creating concentric arcs adjacent to the measured arcs. The exact radius of these concentric arcs is not calibrated to the radius indicia disposed along the edge of the first arm member 10, and merely provide a means of creating supplemental, concentric inner circles inwardly disposed within the measured arc.

Figure 2:
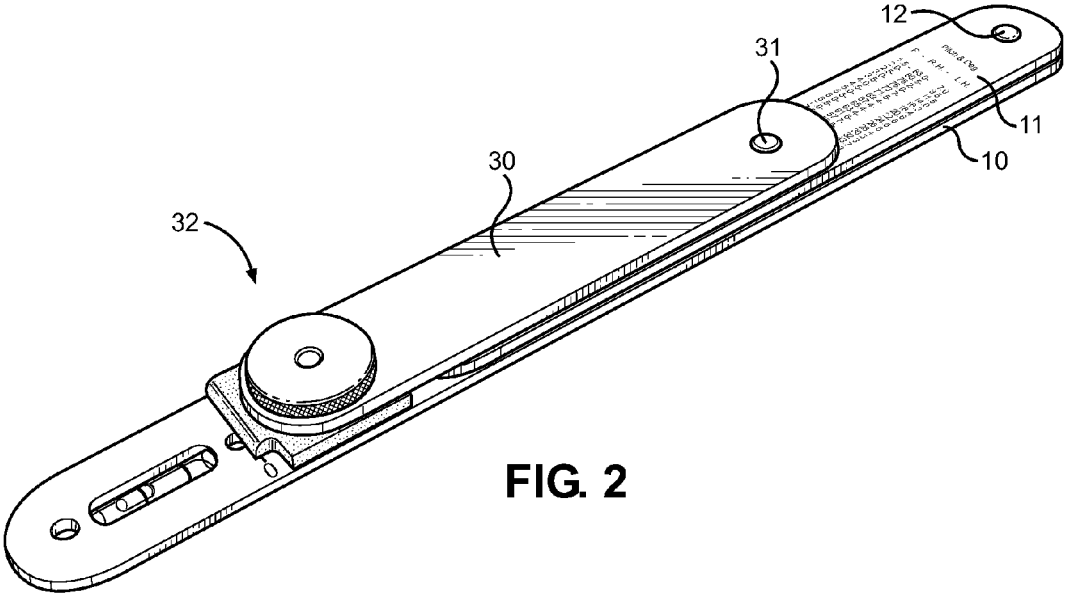
FIG. 2 shows a perspective view of the present invention in a collapsed state.
Figure 3:
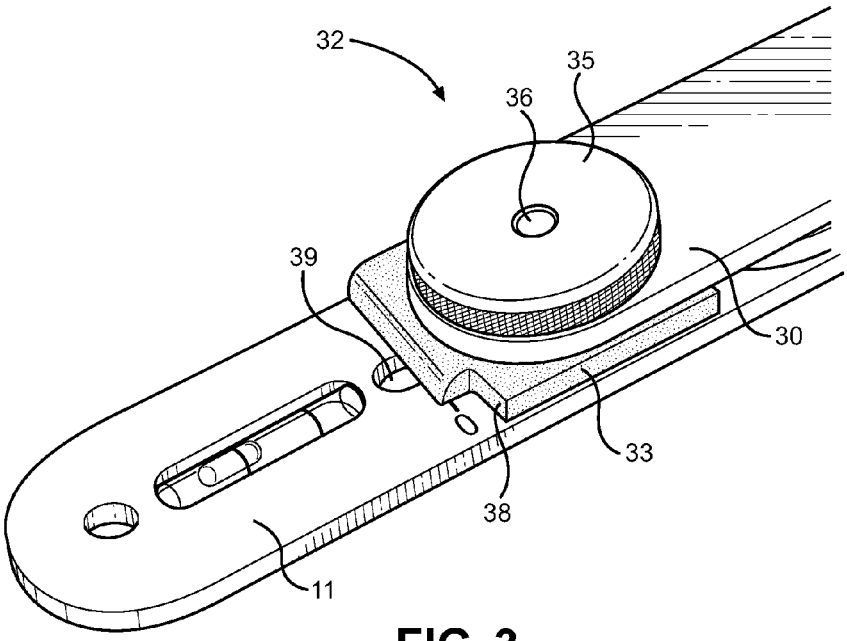
FIG. 3 shows a close-up view of the tightening knob of the present invention.

Referring now to FIGS. 2 and 3, there are shown two views of the assembly in a collapsed, linear state. The construction of the assembly is such that the first arm member 10 and second arm member 11 overlap one another, and the cross member 30 is slidable within the first arm member 10. The length of the cross member 30 is such that the first and second arm members can rotate a full 360 degree rotation without clashing or interference therefrom. The rotation of the second arm member 11 draws the cross member pivot joint 31 away from the first arm member 10, while the tightening knob 32 slides along the channel 39 until it reaches a stop or interior termination. This point is such, and the lengths of each arm and the cross member are such that the device can also be aligned whereby the first and second arm members for a 180 degree separation (parallel and aligned). This facilities use by a left handed or right handed person, and further facilitates large angle measurements.

Referring specifically to FIG. 3, a close-up of the tightening knob 32 is provided. The tightening knob 32 is a hand-turn knob 35 that the user can grasp and rotate. The knob 35 is secured to a fastener 36 that extends through the cross member 30, through the polymer washer, through the channel 39 and into a countersunk nut along the backside of the second arm member 11. The fastener is threaded such that rotation of the tightening knob increases or decreases the clearance between this stack-up of members. This can be used to increase pressure on the assembly to sandwich the cross member 30, washer 33 and second arm member 11 between the knob 35 and the underlying nut, or used to reduce the pressure such that free sliding is accommodated.

Figure 4:
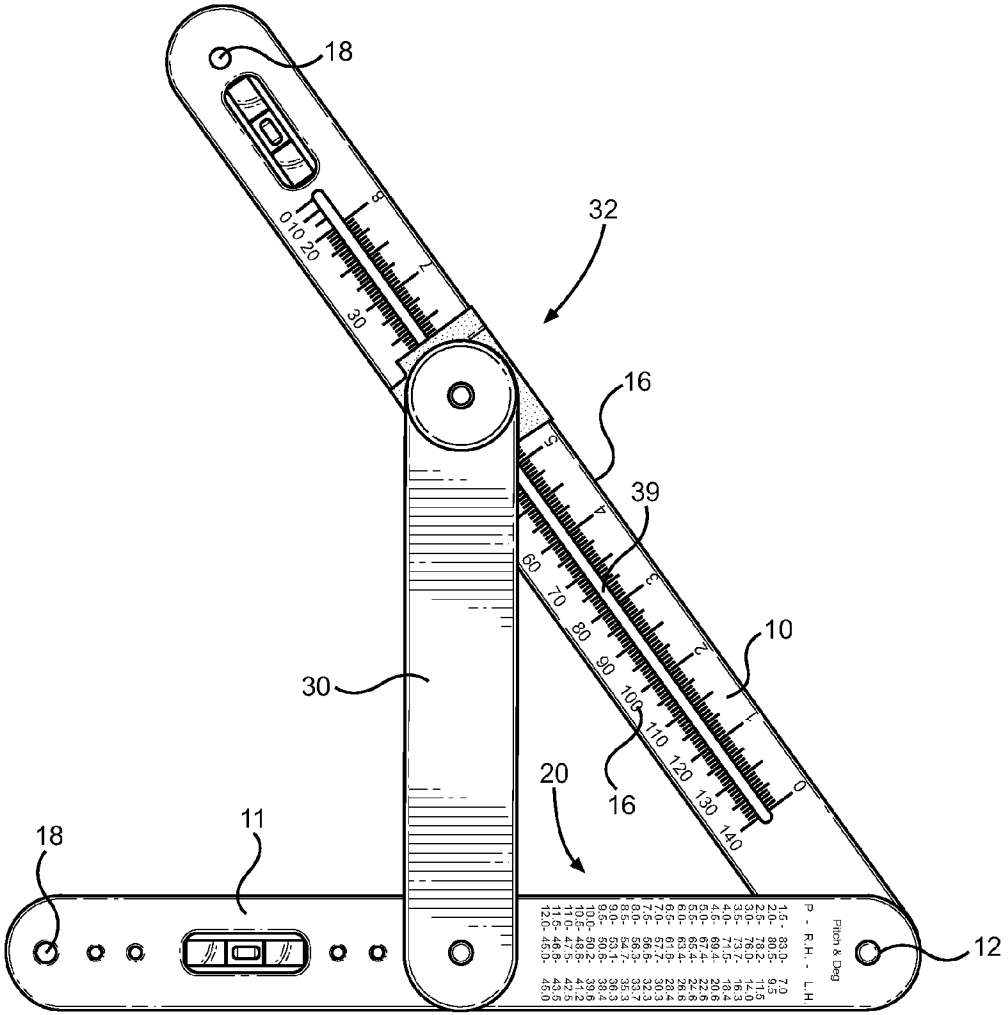
FIG. 4 shows a frontal view of the device in an expanded state.
Figure 5:
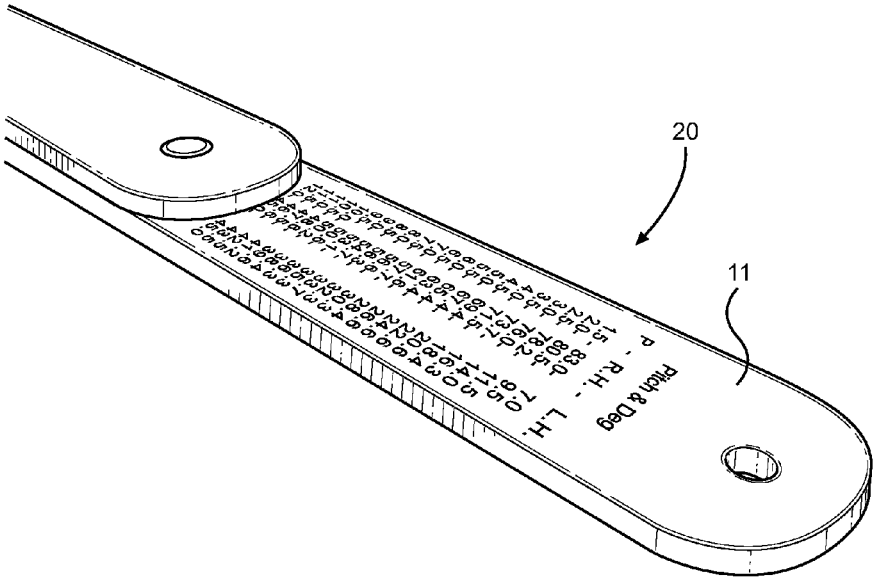
FIG. 5 shows a view of the quick reference guide indicia on one of the arm members.

Referring now to FIGS. 4 and 5, the measurement indicia and the quick reference roof pitch indicia 20 are clearly shown. The quick reference indicia 20 comprises a table of roof pitch ratios versus angular measurements, wherein the device can be placed on the interior surface of the roof or the exterior surface and quickly referenced in the table. Roof pitch is generally provided as a ratio, while measurements are taken in degrees. The table 20 includes pitch ratio (P) along one column, right hand angular measurements (RH) in degrees in a second column, and left hand angular measurements (LH) in degrees in a third column. The RH and LH measurements are components of 90 degree angles and will be chose based on the surface of the roof being used to take the measurement (interior or exterior), as well as which arm member is being positioned against the roof surface. Appropriate instructions are provided to the user upon purchase to train the user such that he or she can easily navigate the quick reference table to determine the roof pitch based on angular measurements.

Figure 6:
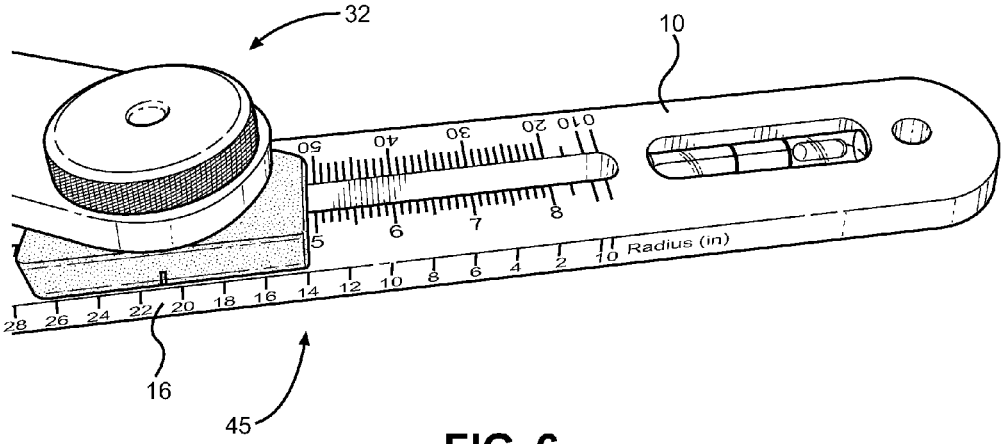
FIG. 6 shows the outer edge of the arm member in which the protractor radius indicia is located.

Referring now to FIG. 6 there is shown finally the radius measurement indicia 45, which is adapted to be disposed along an edge (inner or outer edge) of the first arm member 10. The distance between the writing utensil apertures is provided and calibrated based on the separation of the two arm members, whereby this distance represents the radius of an arc length or circle created when the device is used as a protractor. A notch or indicator on the polymer washer may also be provided to accurately align the tightening knob to a desired radius before tightening, whereafter a first and second writing utensil are placed into the outermost writing utensil apertures. One of the utensils remains stationary, forming the center point of the arc, while the second writing utensil is rotation thereabout, in the same manner as a protractor.

It can be difficult to measure angles and transfer those measurements to another place for record keeping. This process often involves mathematical formulas and calculations on a calculator or notebook paper, which can clutter workspaces. Additionally, miscalculating measurements and angles can be time consuming and can also waste raw materials. Errors when transferring data can be costly, frustrating, and highly inconvenient. The present invention provides a measuring tool that can be used as a construction square, a compass, a ruler, and a protractor. Different forms of measurement indicia are provided for each application, while a quick reference table is provided to transfer angular measurements into roof pitch ratios. The assembly therefore provides an easy and accurate way to measure and transfer angles, alleviates the occurrence of calculating incorrect conversions, and saves a significant amount of time and frustration when measuring roof pitch angles or taking different forms of measurements.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pivoting construction square and multipurpose measuring tool, comprising:

a first arm member including a first end and a second end;

a second arm member including a first end and a second end;

a pivot joint pivotably connecting the first end of the first arm member to the first end of the second arm member, such that the first end of the second arm member is concentrically positioned above the first end of the first arm member;

a cross member having a first end and a second end, said first end being pivotably connected to said second arm member at a cross member pivot joint, and said second end being slidably disposed in an elongated channel extending along the linear length of said first arm member;

a washer disposed between the second end of the cross member and the first arm member, the washer configured to facilitate free sliding of the second end of the cross member along the elongated channel;

a tightening knob and a fastener disposed on the second end of the cross member, the fastener extending through the washer and the elongated channel, the fastener coupling the tightening knob to the second end of the cross member and the washer to the first arm member;

said tightening knob adapted to lock said cross member second end in a static state within said channel when tightened, and allow free sliding therein when loosened;

linear ruler indicia disposed on the first arm member;

angular measurement indicia disposed on the first arm member;

radius measurement indicia disposed on the first arm member;

a bubble level disposed on each of said first arm member and said second arm member, each bubble level being in parallel orientation relative to the arm member on which it is disposed;

a writing utensil aperture disposed on the second ends of said first arm member and said second arm member;

roof pitch quick reference indicia comprising an angle-to-pitch conversion table disposed on said second arm member; and a notch positioned on the washer, the notch superimposed above the linear ruler indicia, such that the notch is configured to display the linear ruler indicia corresponding to the positioning of the second end of the cross member along the first arm member.

2. The pivoting construction square and multipurpose measuring tool of claim 1, further comprising a plurality of intermediate utensil apertures disposed on the second end of said second arm member, the plurality of intermediate utensil apertures aligned with the writing utensil aperture of the second arm member and including a diameter less than a diameter of the writing utensil aperture.

3. The pivoting construction square and multipurpose measuring tool of claim 1, wherein said fastener of said tightening knob is threadably connected to a threaded nut disposed within said first arm member and below said elongated channel.

4. The pivoting construction square and multipurpose measuring tool of claim 1, wherein said first arm member, said second arm member, and said cross member are structured such that said first arm member and said second arm member can effectuate a complete rotation without interference.

5. The pivoting construction square and multipurpose measuring tool of claim 1, wherein said radius measurement indicia is calibrated such that said tightening knob position along said first arm member corresponds with the separation of said writing utensil apertures of said first arm member and said second arm member.

6. The pivoting construction square and multipurpose measuring tool of claim 1, wherein said angular measurement indicia is calibrated such that said tightening knob position along said first arm member corresponds with the angular separation of said first arm member and said second arm member.

7. The pivoting construction square and multipurpose measuring tool of claim 1, wherein said linear ruler indicia is disposed along an edge of an upper surface of at least one of the first or second arm members.

8. The pivoting construction square and multipurpose measuring tool of claim 7, wherein said angular measurement indicia is disposed adjacent to the elongated channel of said first arm member.

9. The pivoting construction square and multipurpose measuring tool of claim 8, wherein said radius measurement indicia is disposed along an inner surface of said first arm member.

10. The pivoting construction square and multipurpose measuring tool of claim 1, wherein the washer is composed of a polymer material.

* * * * *